US008201506B1

(12) United States Patent
Parlapiano

(10) Patent No.: US 8,201,506 B1
(45) Date of Patent: Jun. 19, 2012

(54) PORTABLE ANTI-THEFT DEVICE

(76) Inventor: John P. Parlapiano, Upper Montclair, NJ (US)

( * ) Notice: Subject to any disclaimer, the term of this patent is extended or adjusted under 35 U.S.C. 154(b) by 353 days.

(21) Appl. No.: 12/384,864

(22) Filed: Apr. 9, 2009

Related U.S. Application Data

(60) Provisional application No. 61/123,486, filed on Apr. 9, 2008.

(51) Int. Cl.
*E05G 1/00* (2006.01)

(52) U.S. Cl. ..... 109/50; 109/52; 70/14; 70/18; 70/232; 70/201

(58) Field of Classification Search ..... 70/14, 232, 70/201–203, 18; 109/50, 52
See application file for complete search history.

(56) References Cited

U.S. PATENT DOCUMENTS 105,105 A * 7/1870 McIlhenny ..... 70/232
188,540 A * 3/1877 Quackenbush ..... 70/18
725,290 A * 4/1903 Speer ..... 70/232
748,720 A * 1/1904 Glazier ..... 70/178
785,526 A * 3/1905 Simpson ..... 292/307 B
924,824 A * 6/1909 Peebler ..... 70/15
1,326,688 A * 12/1919 Perry ..... 70/18
2,048,424 A * 7/1936 Caldwell ..... 70/232
3,245,240 A * 4/1966 De Forrest ..... 70/209
3,380,267 A * 4/1968 Winchester ..... 70/232
3,710,736 A * 1/1973 Biondi et al. ..... 109/50
4,164,907 A * 8/1979 Piatscheck et al. ..... 109/50
4,373,851 A * 2/1983 Confoey ..... 414/722
4,541,256 A * 9/1985 Green ..... 70/232
4,557,470 A * 12/1985 Link ..... 267/64.12
4,561,273 A * 12/1985 Robinson ..... 70/426
4,803,858 A * 2/1989 Parker ..... 70/231
4,832,163 A * 5/1989 Levesque ..... 190/11
4,838,059 A * 6/1989 Johnson ..... 70/209
4,907,522 A * 3/1990 Lutzke ..... 114/230.28
5,024,303 A * 6/1991 Kosloff ..... 188/300
5,033,280 A * 7/1991 Johnson ..... 70/232
5,036,683 A * 8/1991 Geuvjehizian ..... 70/18
5,143,108 A * 9/1992 Kenney ..... 135/16
5,193,366 A * 3/1993 Brinkman ..... 70/18
5,199,361 A * 4/1993 Robinson ..... 109/51
5,201,202 A * 4/1993 Kam ..... 70/168
5,417,093 A * 5/1995 Heiberg ..... 70/232
5,746,074 A * 5/1998 Collins ..... 70/18
6,082,157 A * 7/2000 Boyce ..... 70/58
6,393,880 B1 * 5/2002 Vance, Sr. ..... 70/174
6,554,012 B2 * 4/2003 Patarra ..... 135/16
6,874,338 B1 * 4/2005 Hunt et al. ..... 70/14
7,559,218 B2 * 7/2009 Soudan, Jr. ..... 70/63
D628,504 S * 12/2010 Sayegh et al. ..... D10/106.92
7,980,185 B1 * 7/2011 Teague, Jr. ..... 109/50

* cited by examiner

*Primary Examiner* — Suzanne Barrett
(74) *Attorney, Agent, or Firm* — David M. Conoughey

(57) ABSTRACT

A portable anti-theft device for attachment to a piece of portable outdoor furniture comprises a base attachable to the outdoor furniture and a hollow security shell attachable to the base. The base comprises a segmented tubular body comprising at least two semitubular segments and having an inner peripheral surface; longitudinally opposed stops extending outwardly from the base, and a closure for attaching, the base to the portable outdoor furniture. The hollow security shell comprises a first shell segment and a second shell segment (the first and second shell segments defining an enclosed internal space with a pair of vertically-opposed apertures), and a hinge joining said first and second half shells, the security shell being configured to enclose the closure.

12 Claims, 21 Drawing Sheets

PORTABLE ANTI-THEFT DEVICE

CROSS-REFERENCE TO RELATED APPLICATION

Applicant claims the benefit of the priority of U.S. Patent Application Ser. No. 61/123,486, filed Apr. 9, 2008.

BACKGROUND OF THE INVENTION

At the present time, if an individual or group goes on an outdoor recreational excursion (for example to a beach, such as for a day of swimming, sunbathing, and similar recreational activities), it is common for them to bring, or rent, a foldable beach umbrella or a folding beach chair. The folding umbrella is used to provide shade on exposed beaches. (The increasing focus on preventing skin cancer is likely to encourage more people to use umbrellas at the beach.) The folding beach chair is used to sit. Additionally, beachgoers frequently bring valuable possessions with them. These may include wallets, house or car keys, cell phones, digital cameras, MP3 players, etc. These possessions are generally small, valuable and easy targets for theft. Because of the nature of an outdoor recreational area, such as a beach, there are generally no facilities or other resources to secure these valuables. This presents beachgoers with a difficult choice: either one person must remain with the valuables at all times or the valuables must be hidden (in clothing or under other belongings.) This second choice results in many thefts of unattended property as beachgoers leave their valuables and casual thieves remove them.

Accordingly, there is a need to provide, in combination, a locking container suitable for storing valuables while at the outdoor recreational area, such as a beach or a similar location, and an anchoring device which will attach to a folding beach umbrella or folding chair and provide a base for the locking container.

BRIEF SUMMARY OF THE INVENTION

A portable anti-theft device for attachment to a piece of portable outdoor furniture comprises a base attachable to the outdoor furniture and a hollow security shell attachable to the base. The base comprises a segmented tubular body comprising at least two semitubular segments and having an inner peripheral surface; longitudinally opposed stops extending outwardly from the base, and a closure for attaching the base to the portable outdoor furniture. The hollow security shell comprises a first shell segment and a second shell segment (the first and second shell segments defining an enclosed internal space with a pair of vertically-opposed apertures), and a hinge joining said first and second half shells, the security shell being configured to enclose the closure.

DETAILED DESCRIPTION OF THE INVENTION

The portable anti-theft device 1 of the present invention is illustrated in FIGS. 1-17 and comprises a tubular base 20 and a security shell 100. The tubular base 20 is configured to enclose a portion Sofa piece of foldable portable furniture and to be removably secured to that portion S against removal. In turn, the security shell 100 is configured to enclose the tubular base 20 and to be removably secured to it. The security shell 100, as installed on the tubular base 20, also defines a completely enclosed and lockable space for retaining articles in resistance against theft.

Figure 1:
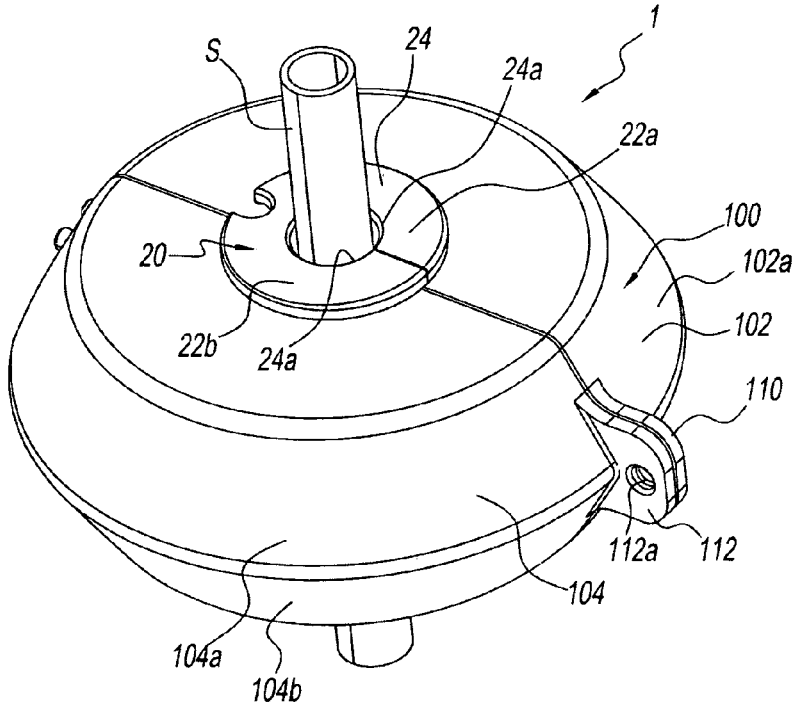
FIG. 1 is a perspective view of the portable anti-theft device of the present invention.
Figure 2:
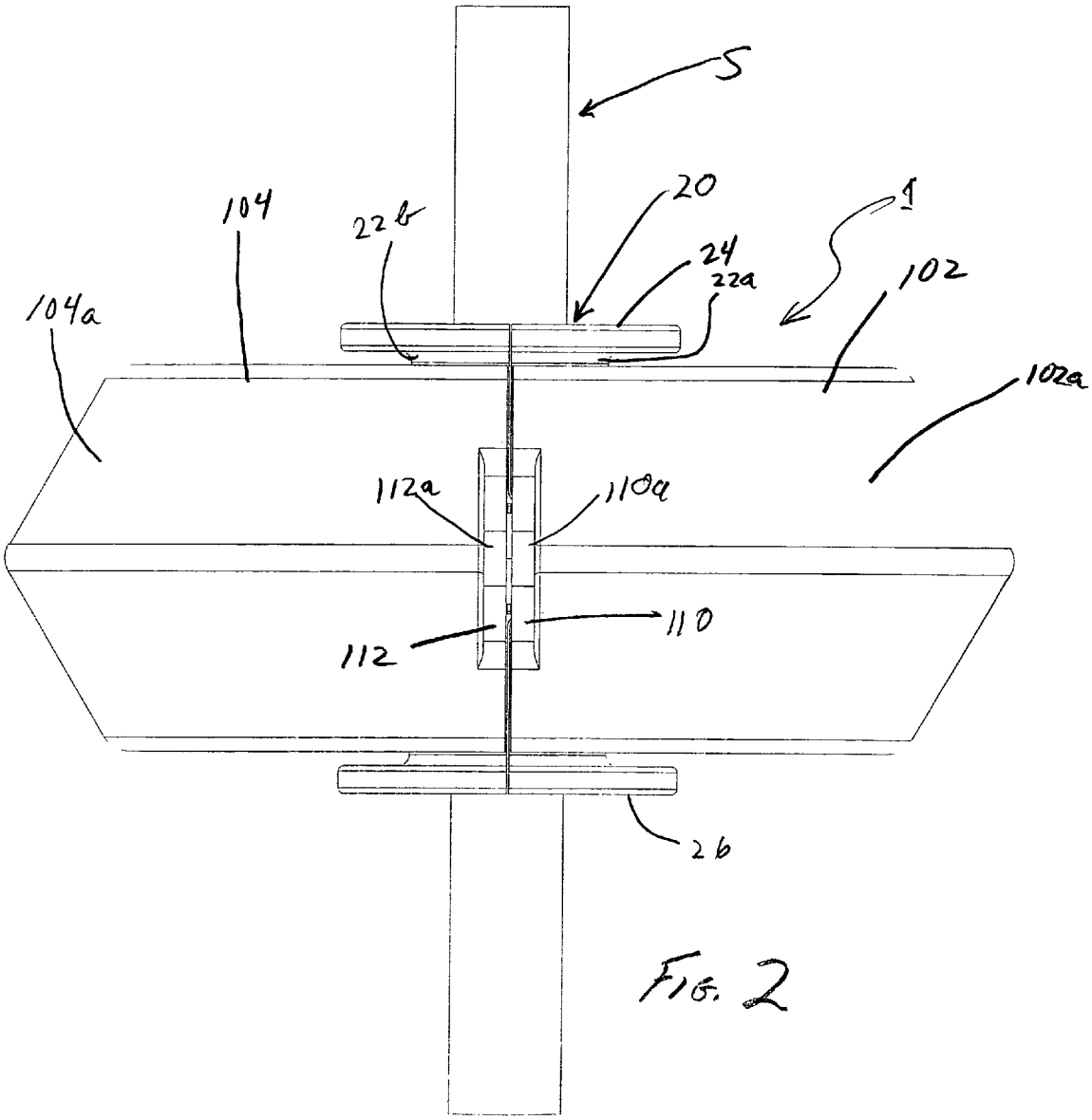
FIG. 2 is a front elevation view of the portable anti-theft device of the present invention.
Figure 3:
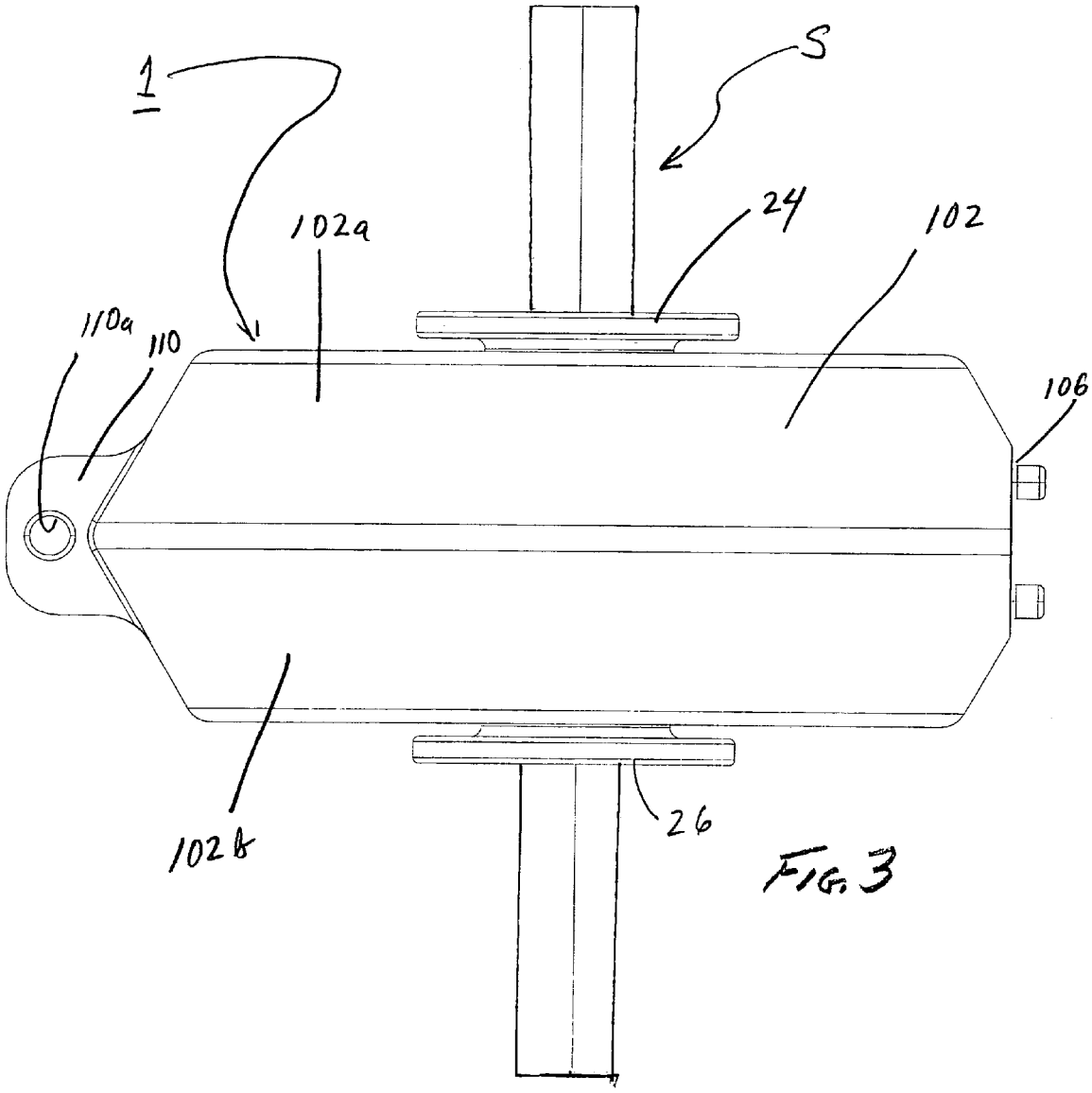
FIG. 3 is a side elevation view of the portable anti-theft device of the present invention.
Figure 4:
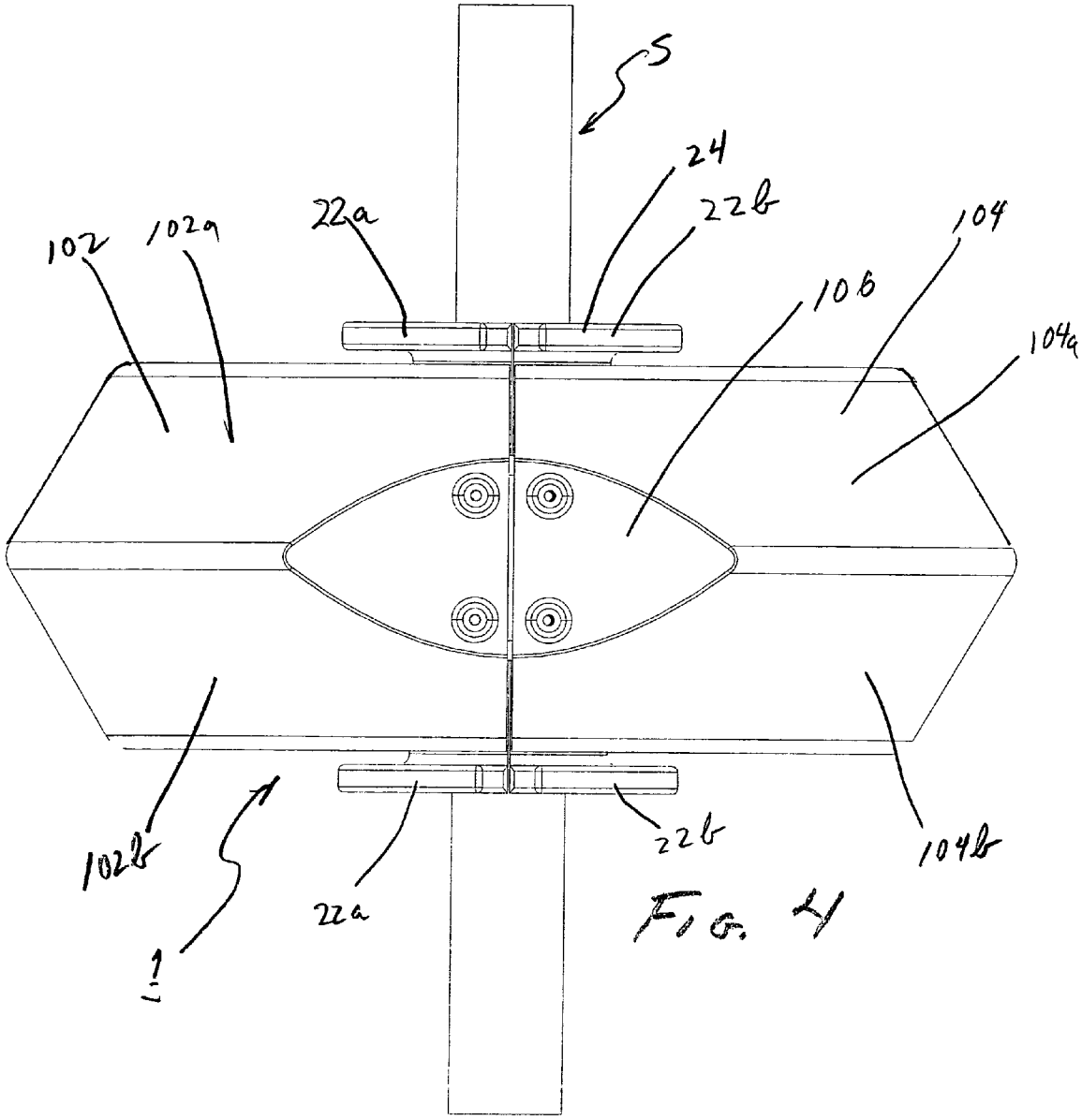
FIG. 4 is a rear elevation view of the portable anti-theft device of the present invention.
Figure 5:
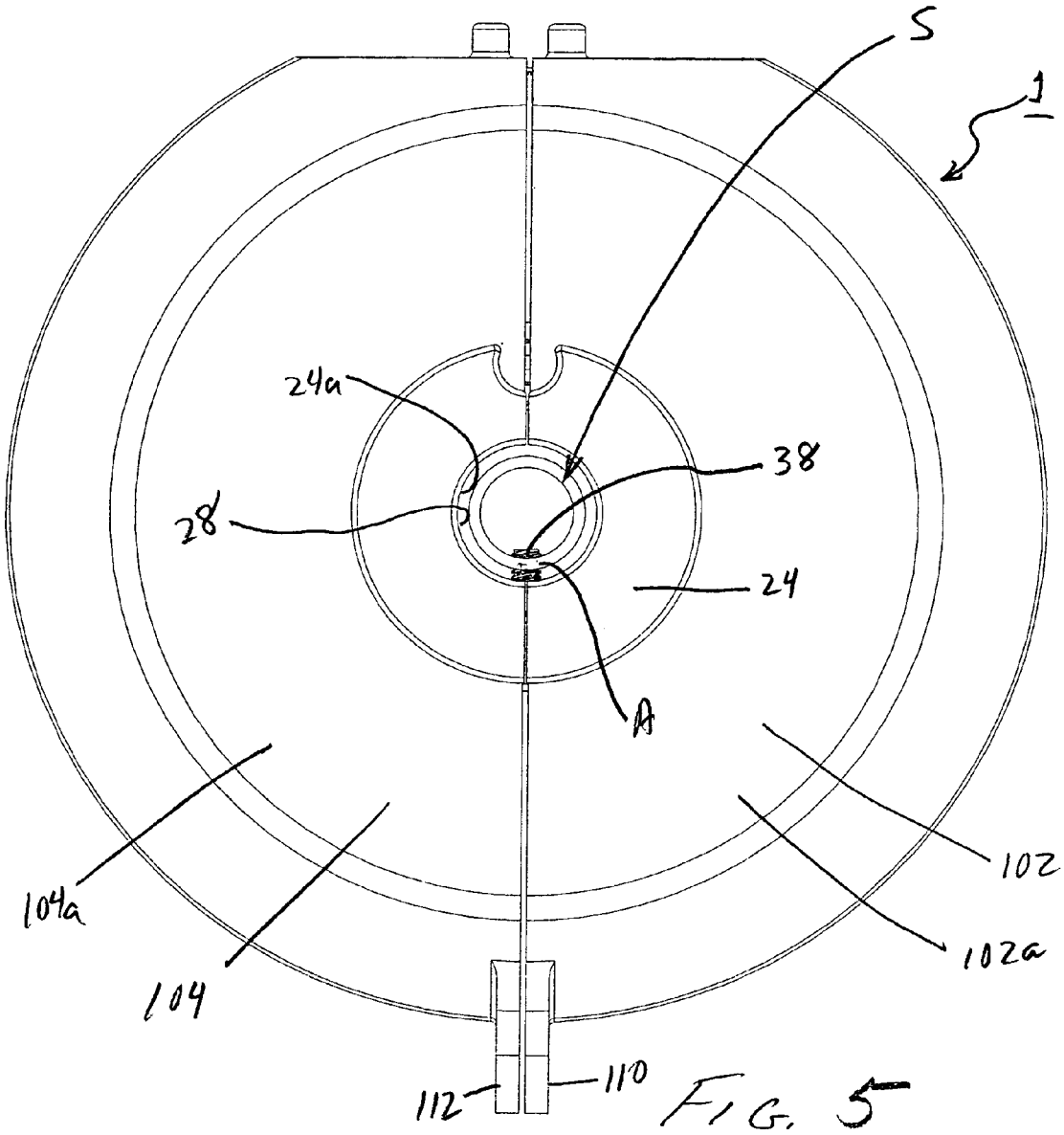
FIG. 5 is a top plan elevation view of the portable anti-theft device of the present invention.
Figure 6:
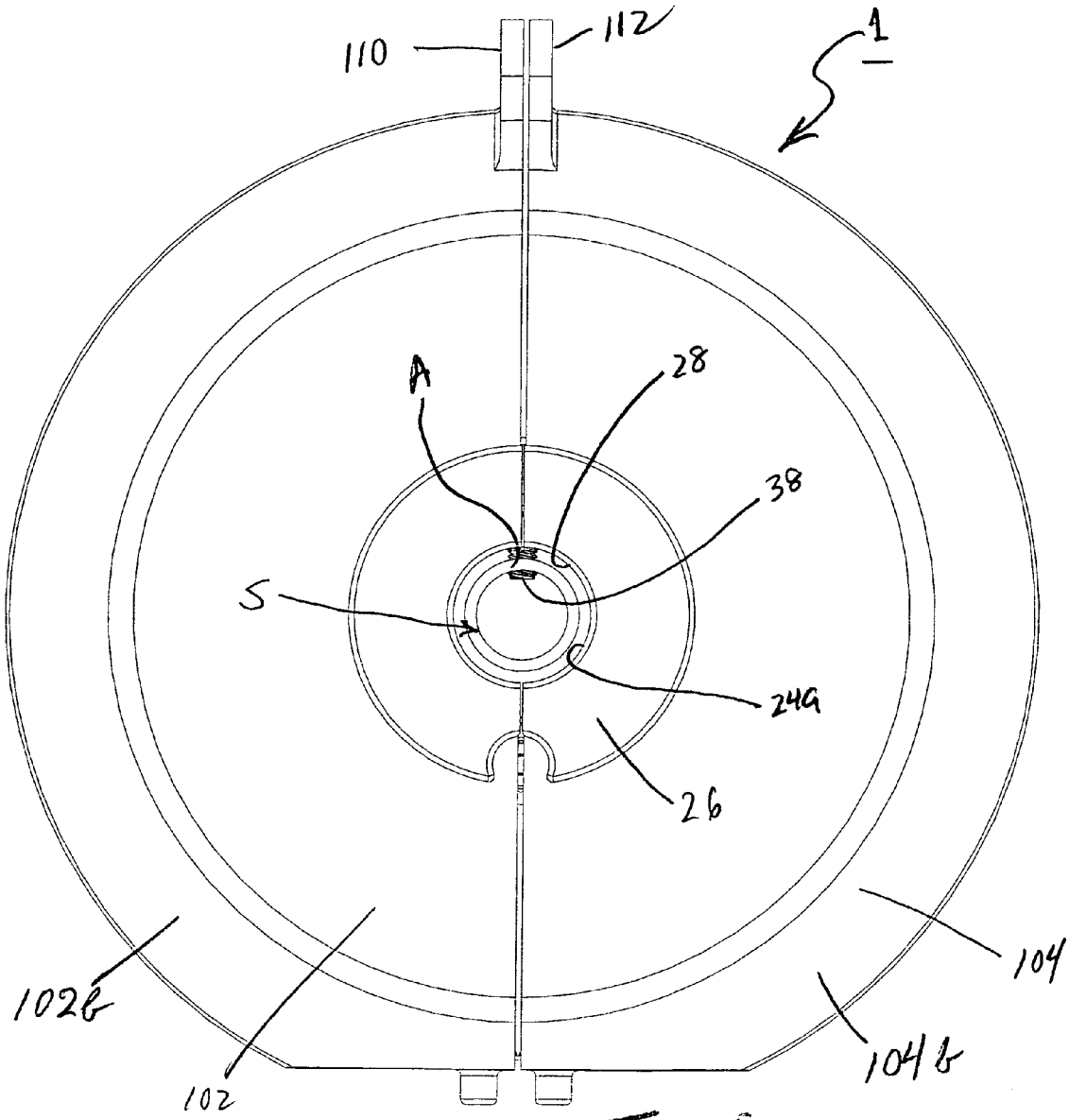
FIG. 6 is a bottom plan view of the portable anti-theft device of the present invention.
Figure 7:
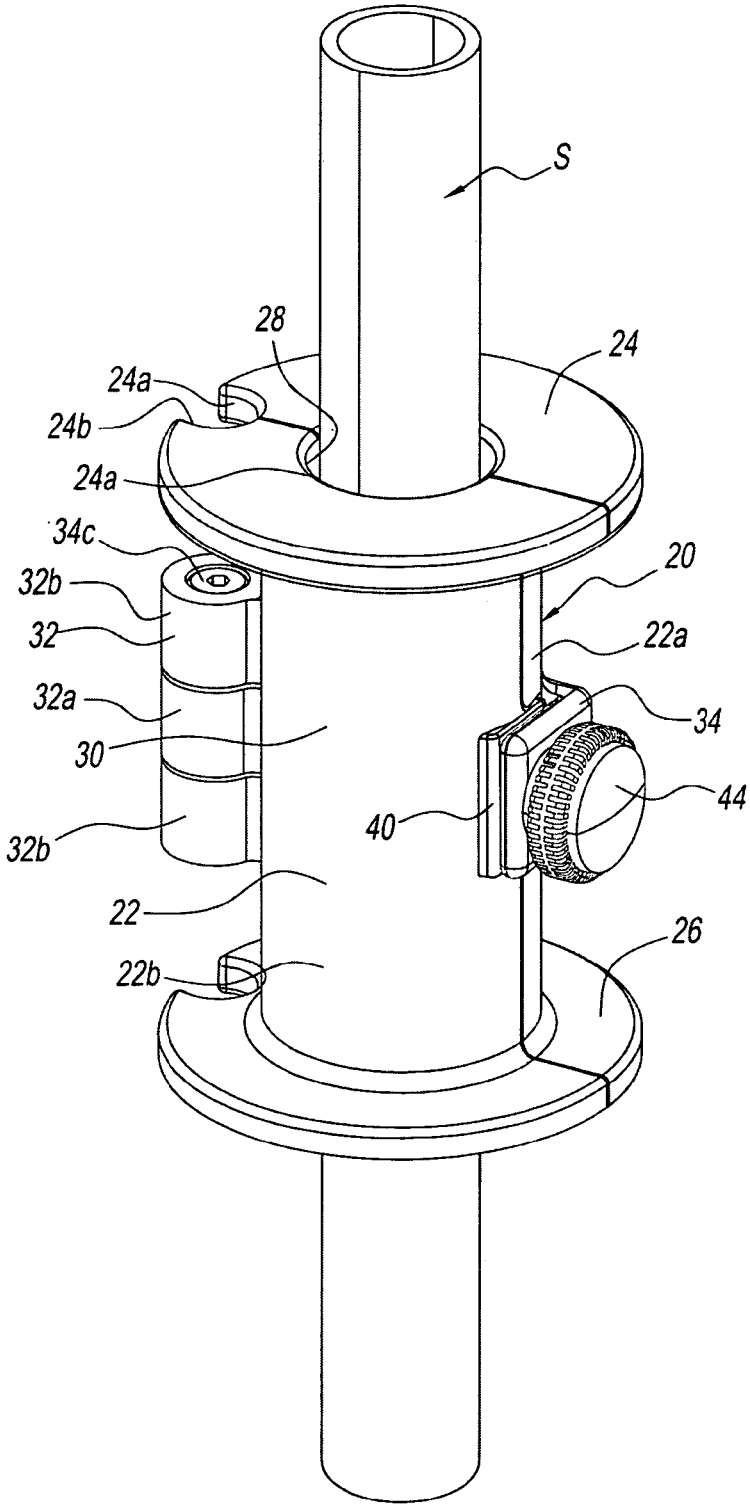
FIG. 7. is a perspective view of the base of the portable anti-theft device of the present invention.
Figure 8:
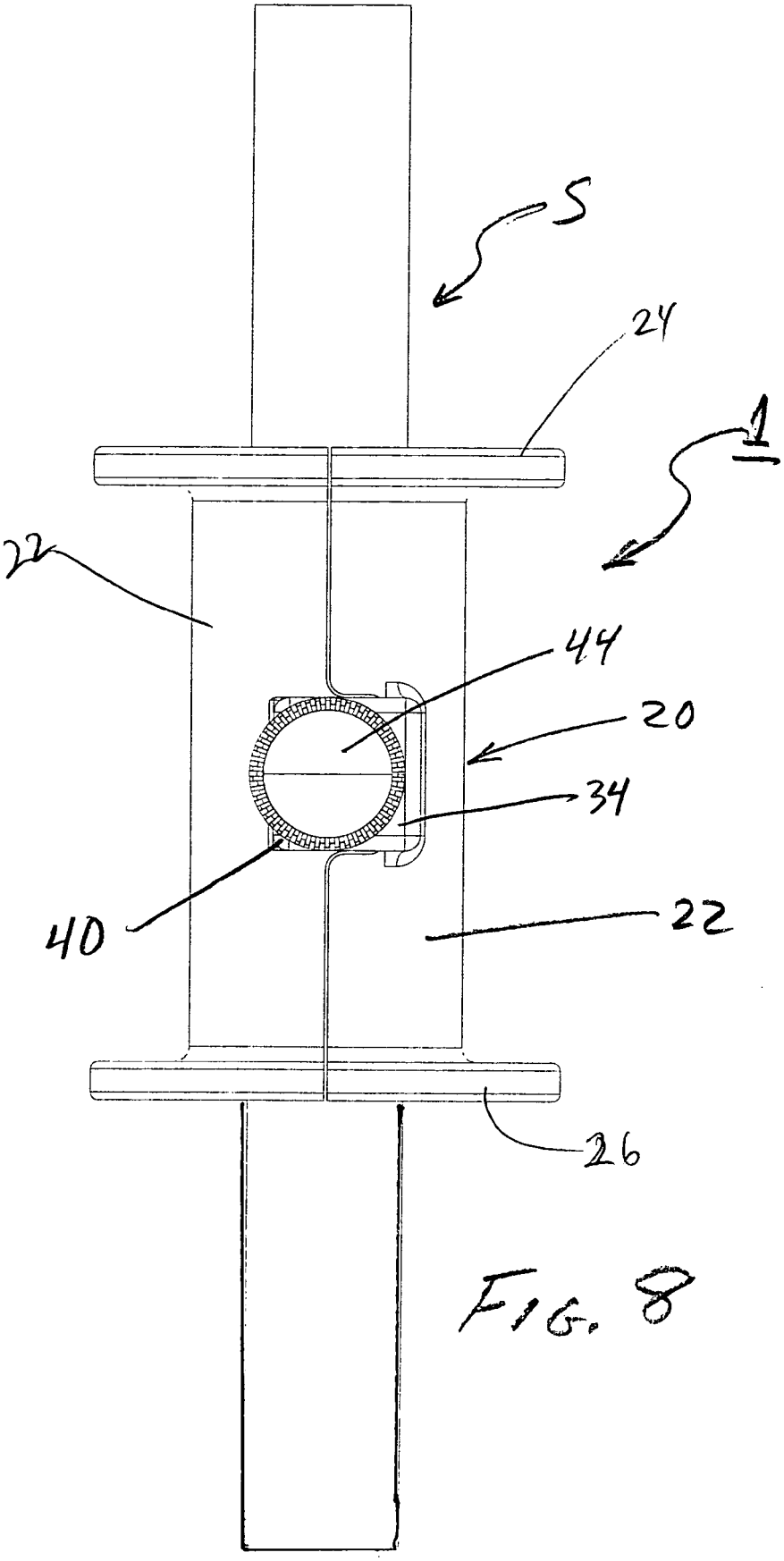
FIG. 8. is a front elevation view of the base of the portable anti-theft device of the present invention.
Figure 9:
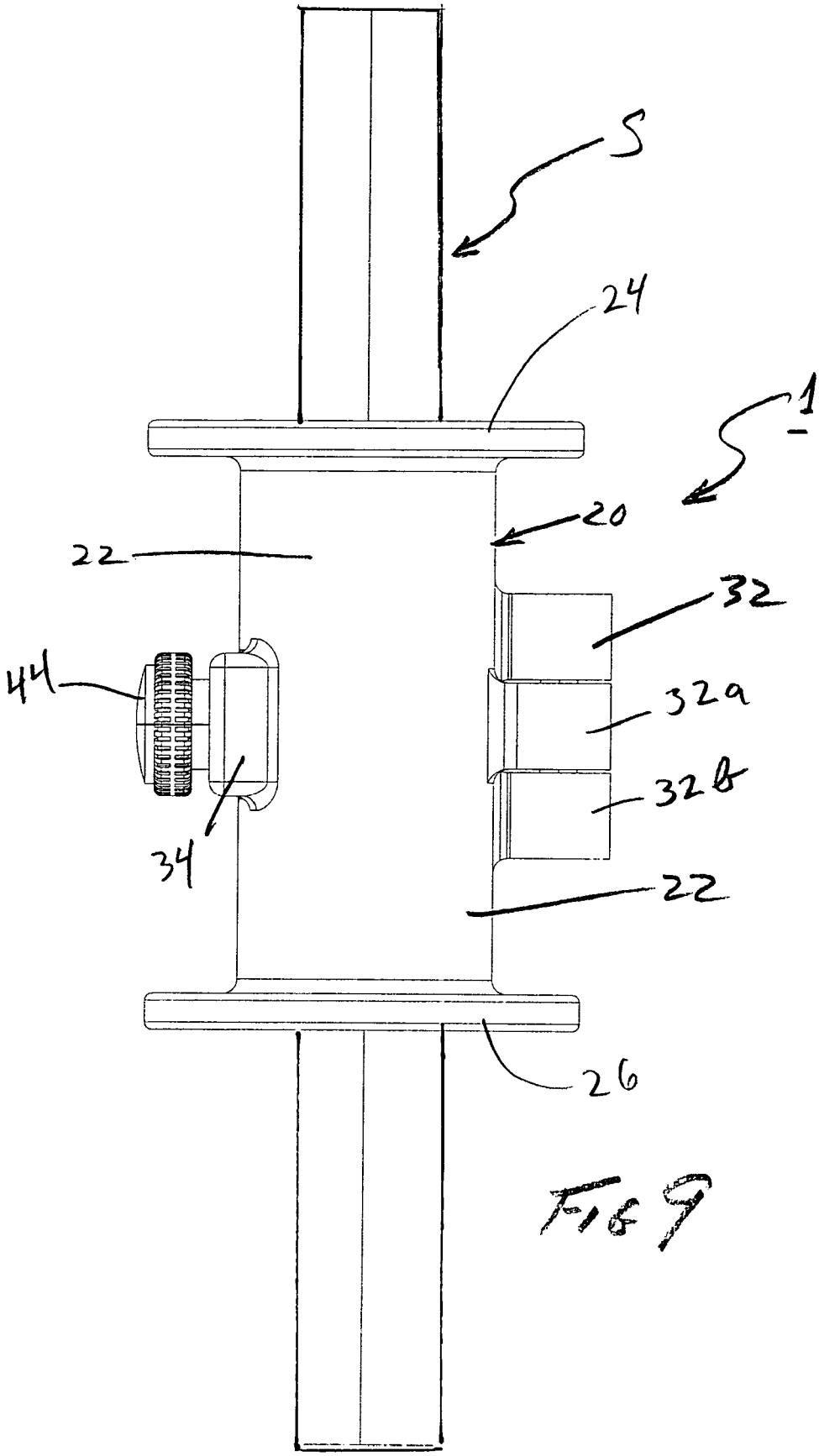
FIG. 9. is a side elevation view of the base of the portable anti-theft device of the present invention.
Figure 10:
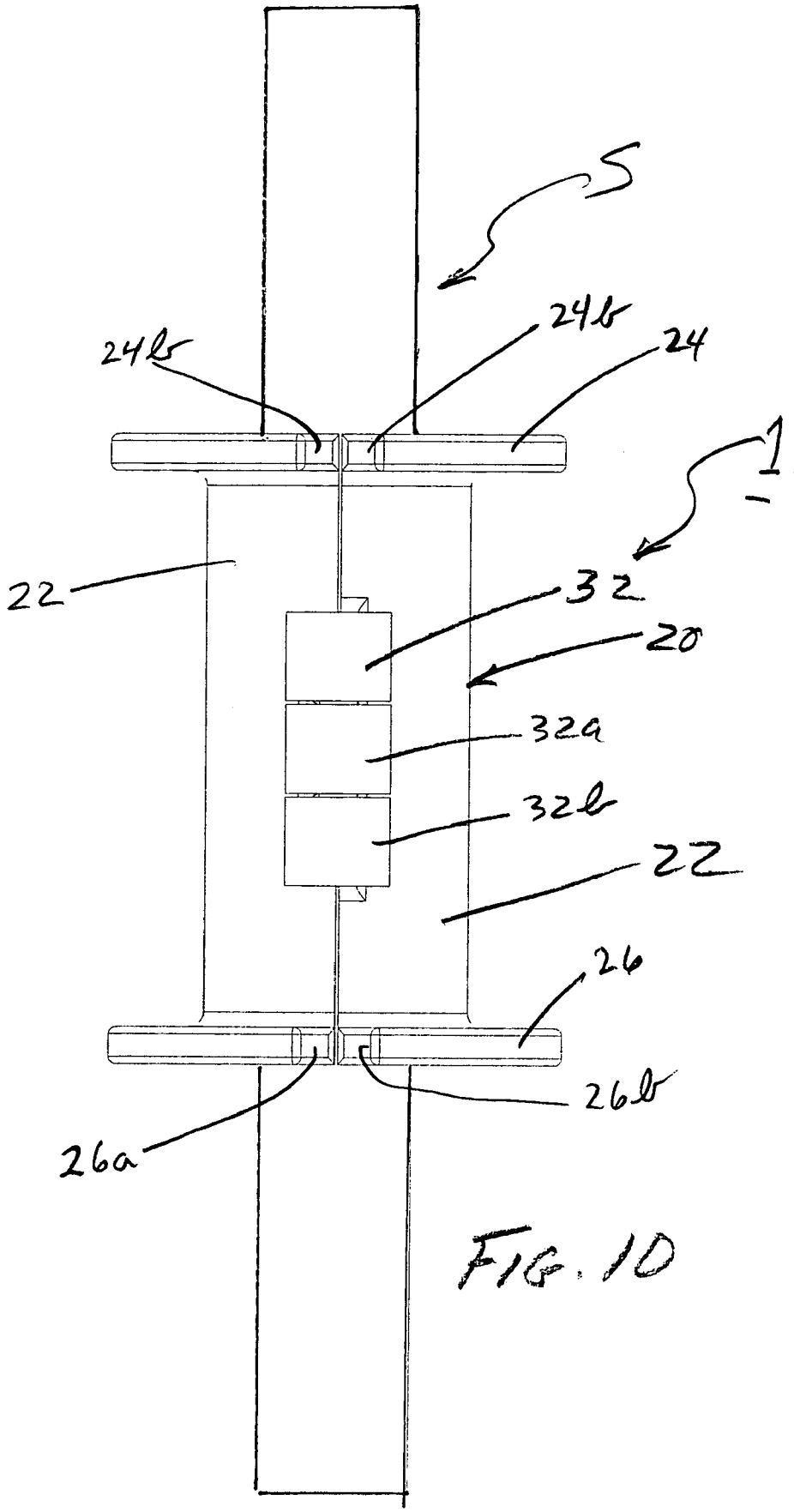
FIG. 10. is a rear elevation view of the base of the portable anti-theft device of the present invention.
Figure 11:
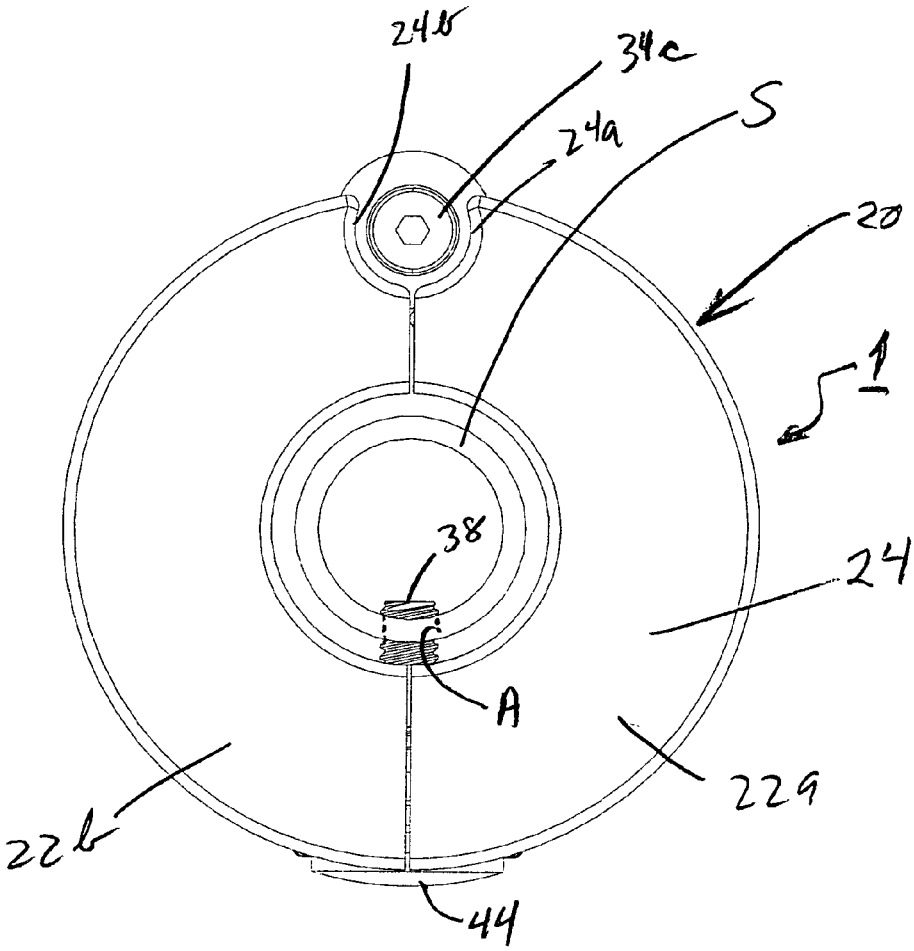
FIG. 11. is a top plan view of the base of the portable anti-theft device of the present invention.
Figure 12:
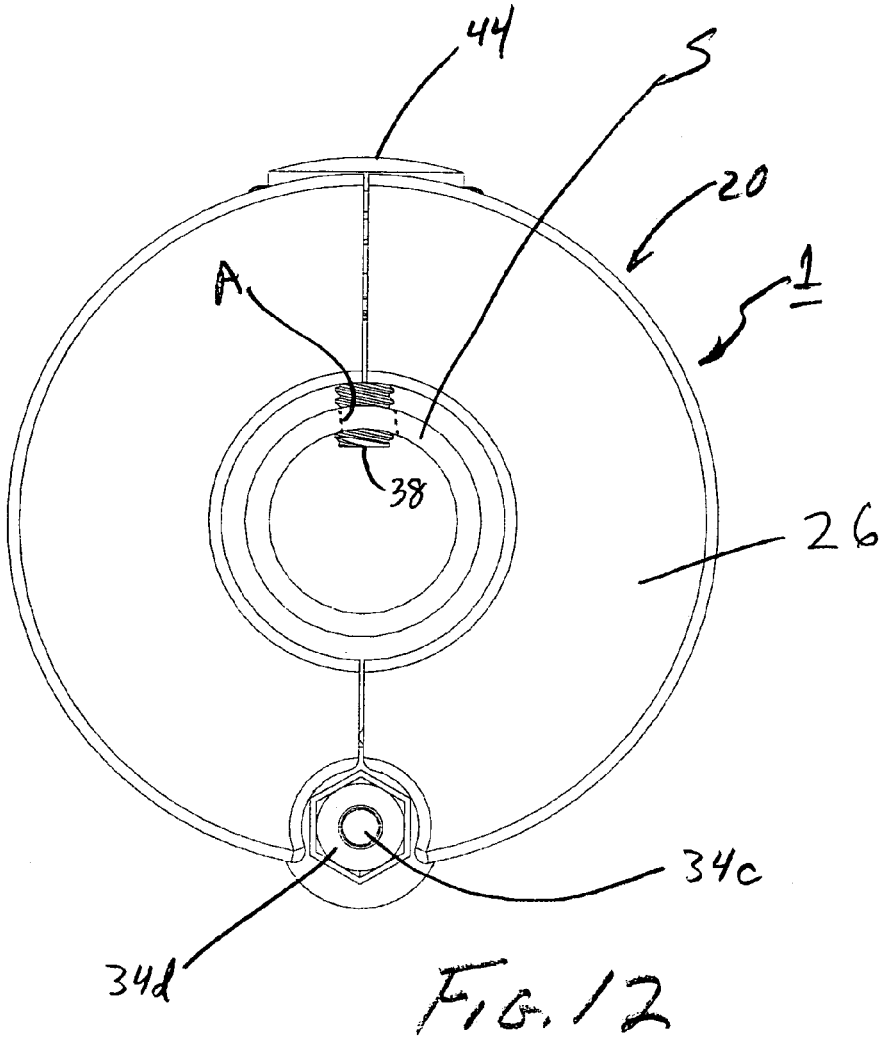
FIG. 12. is a bottom plan view of the base of the portable anti-theft device of the present invention.
Figure 13:
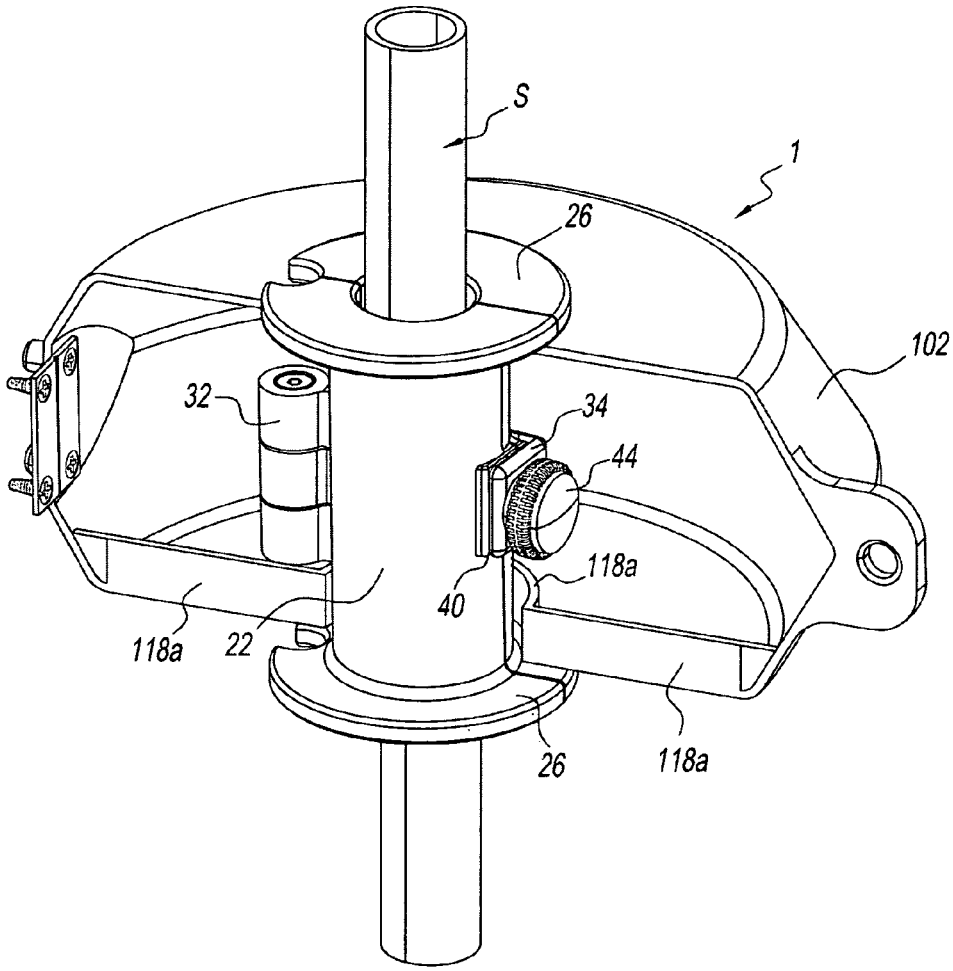
FIG. 13. is a perspective view of the portable anti-theft device of the present invention with one half of the security shell removed.
Figure 14:
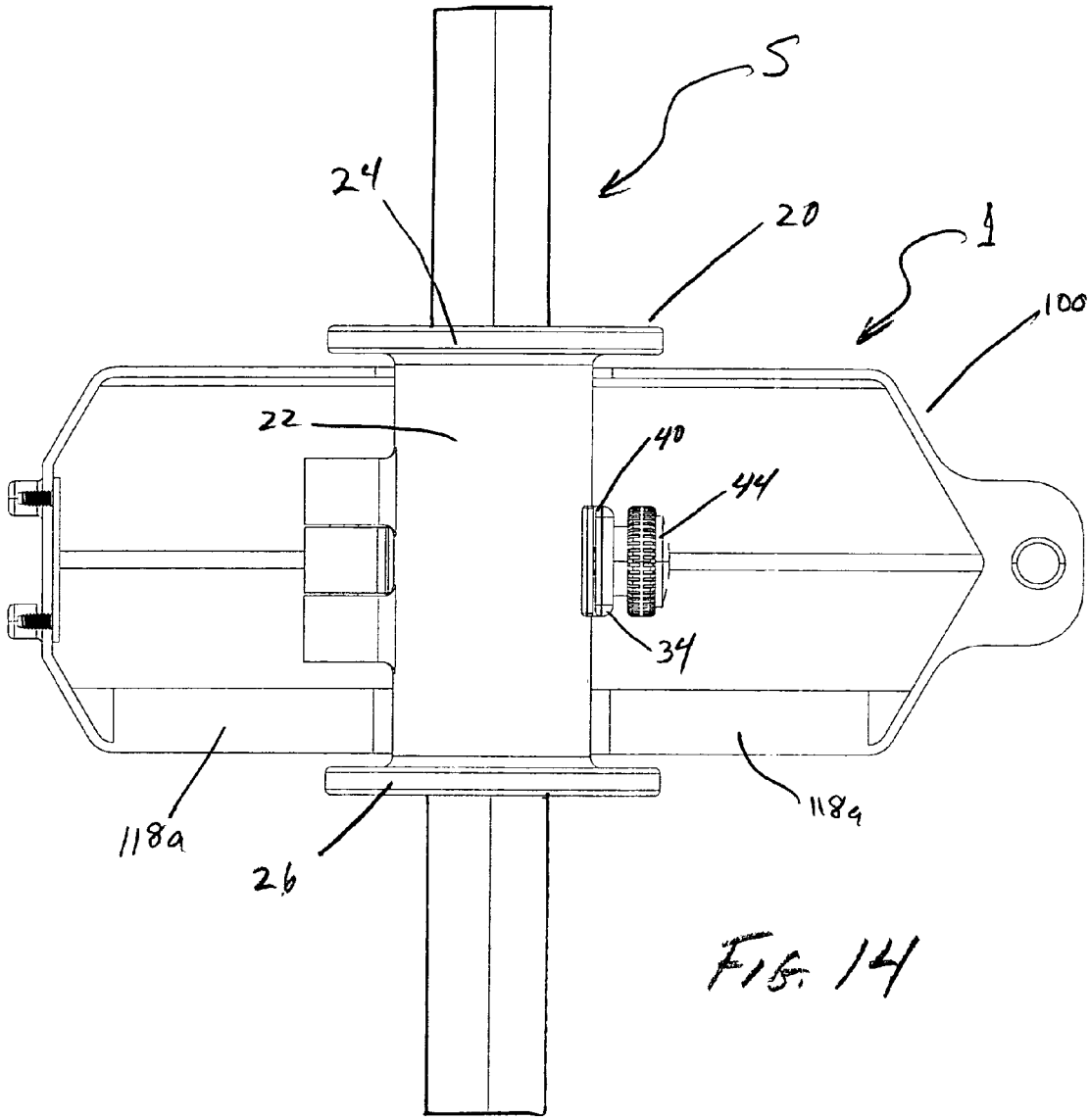
FIG. 14. is a side elevation view of the portable anti-theft device of the present invention with one half of the security removed.
Figure 15:
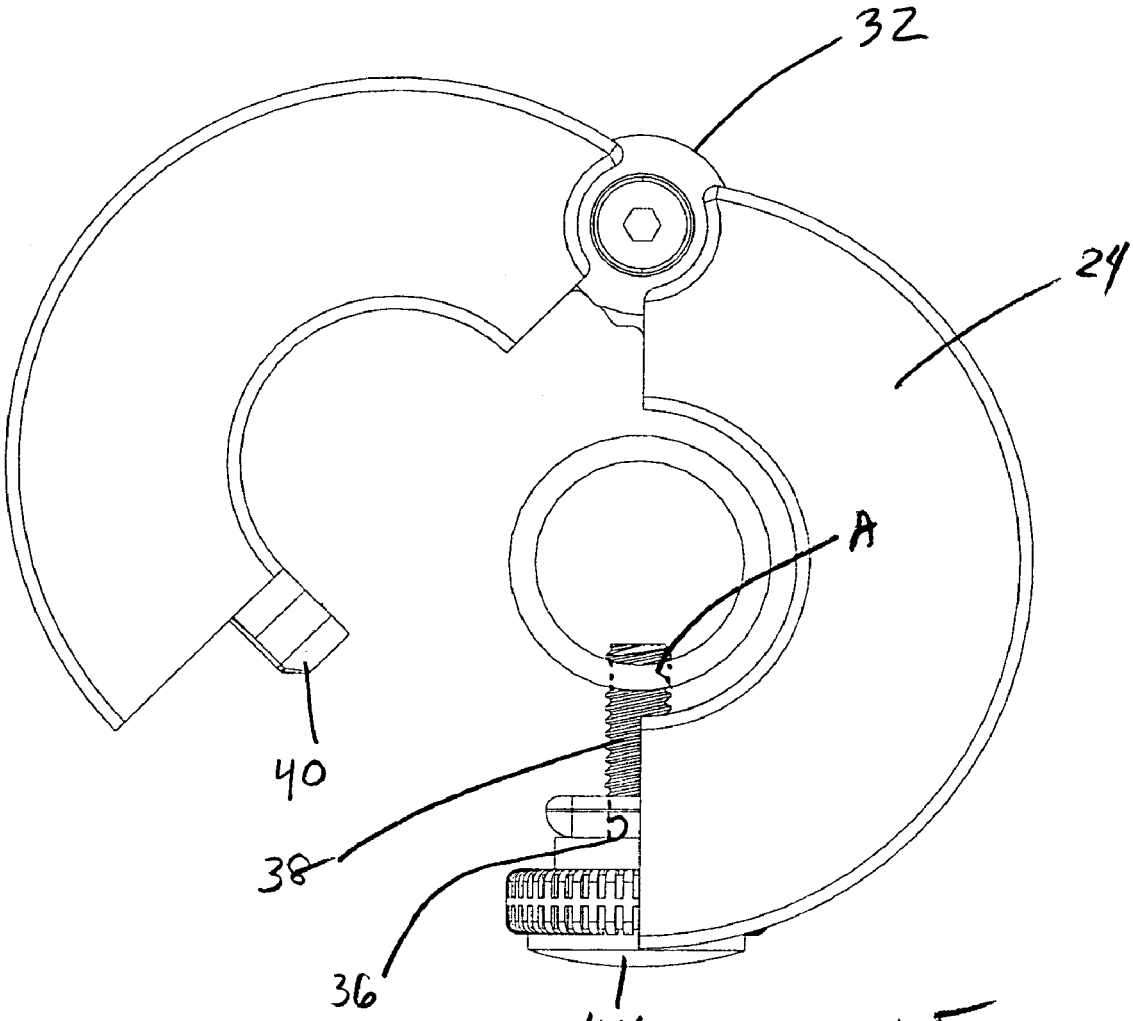
FIG. 15. is a top plan view of the base of the portable anti-theft device of the present invention with the base partially open.
Figure 16:
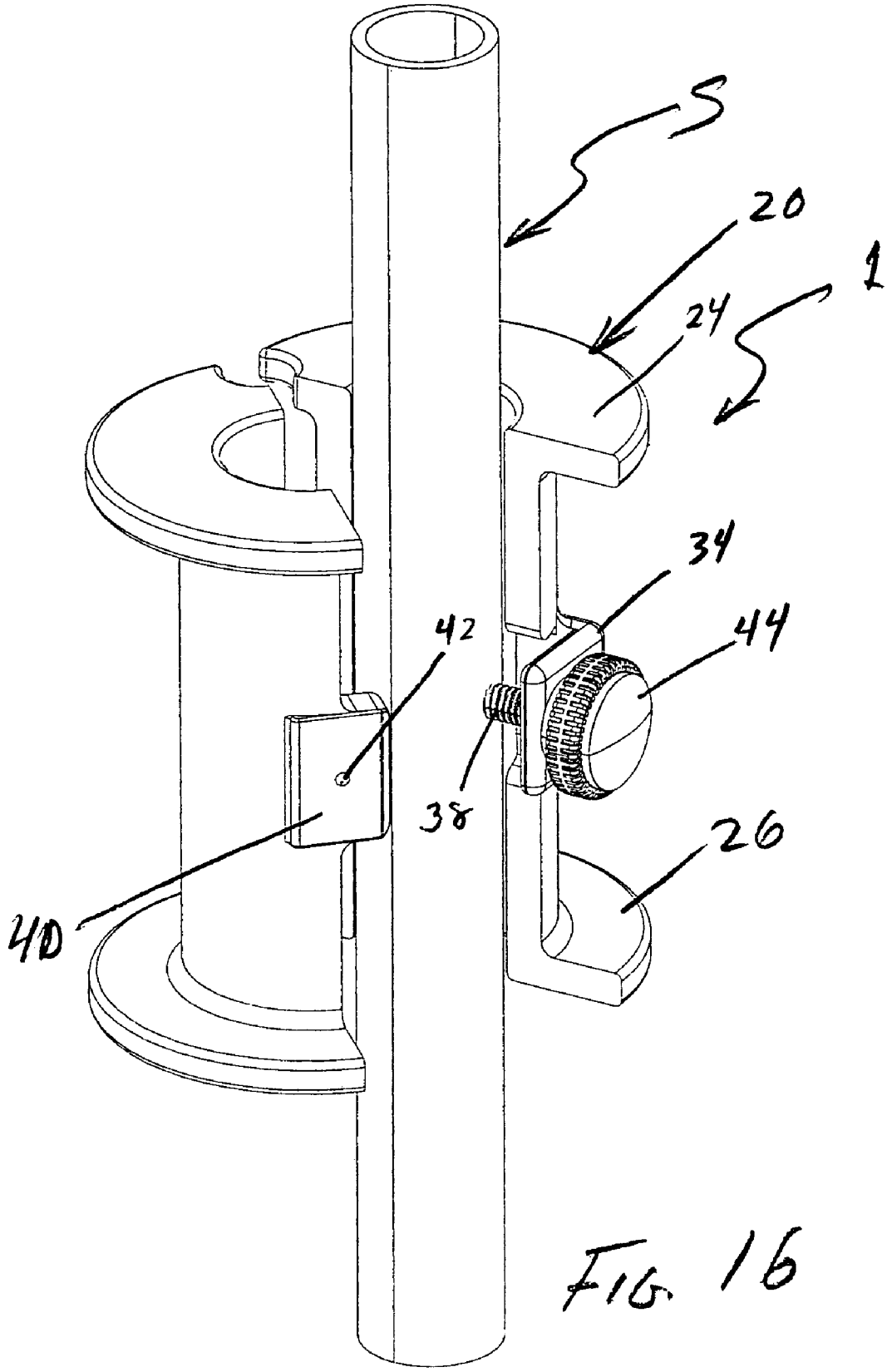
FIG. 16. is a perspective view of the base of the portable anti-theft device of the present invention with the base partially open.
Figure 17:
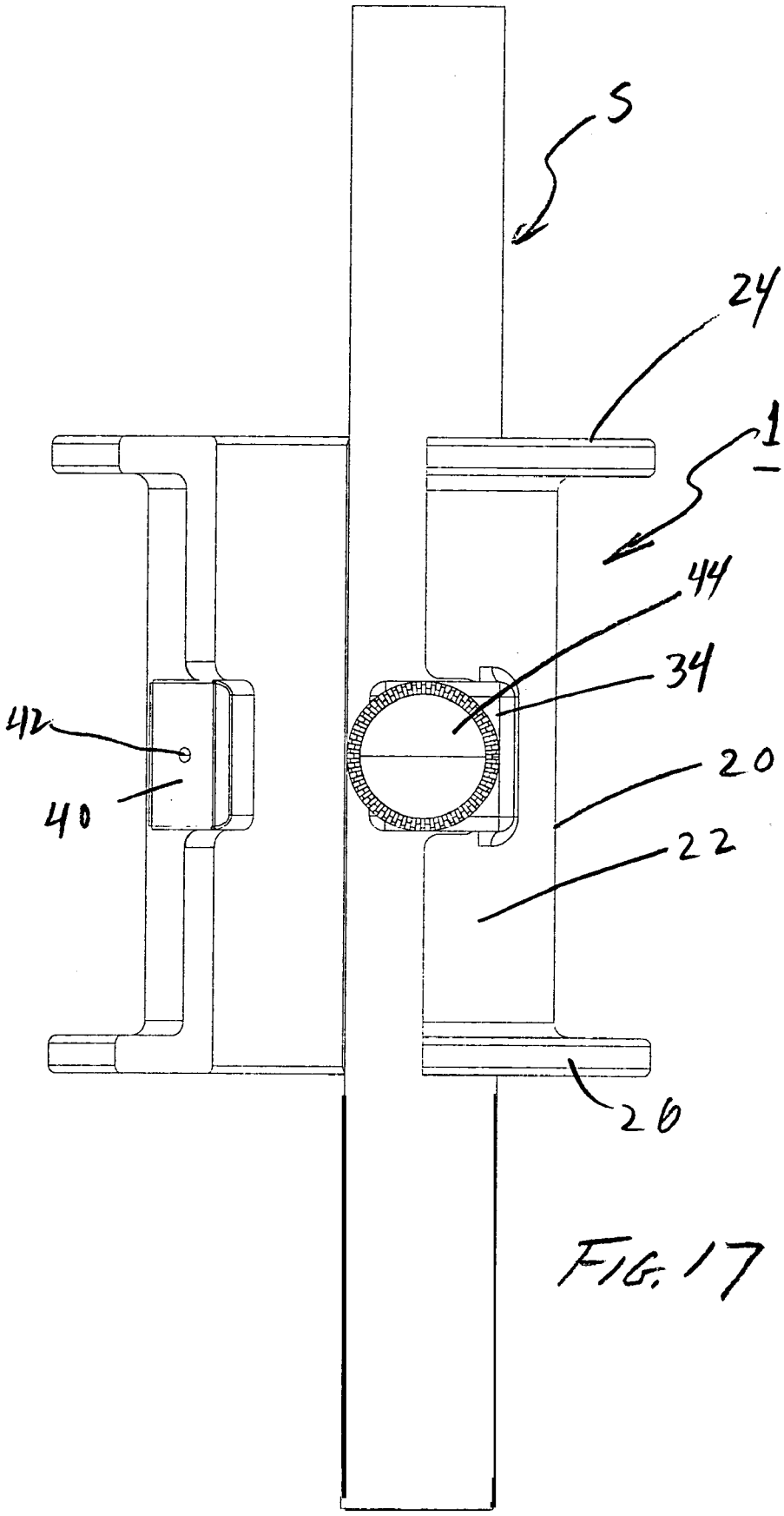
FIG. 17. is a front elevation view of the base of the portable anti-theft device of the present invention with the base partially open.
Figure 18:
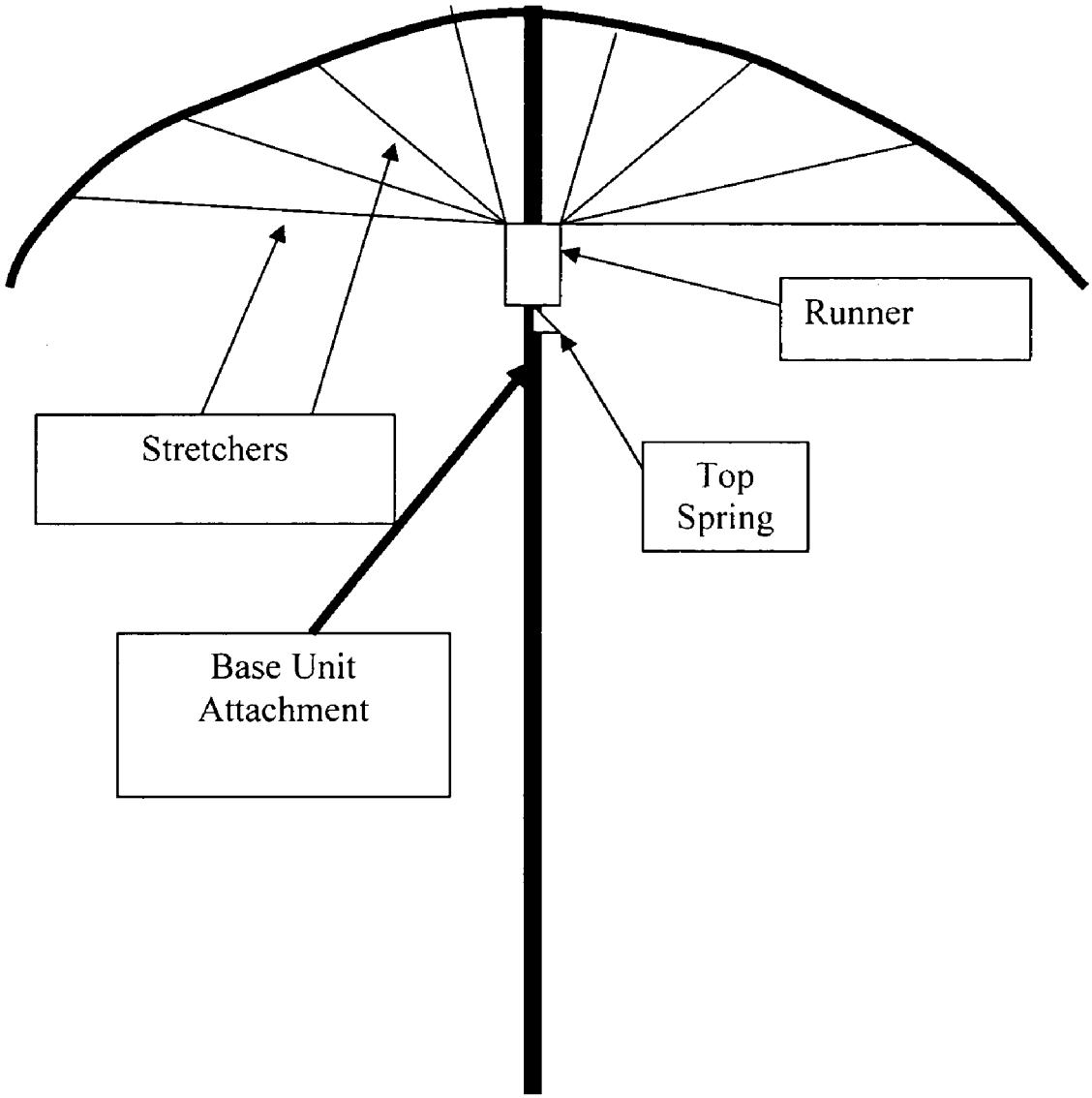
FIG. 18. is a diagrammatic illustration of a generic collapsible beach umbrella for use with the portable anti-theft device of the present invention.
Figure 19:
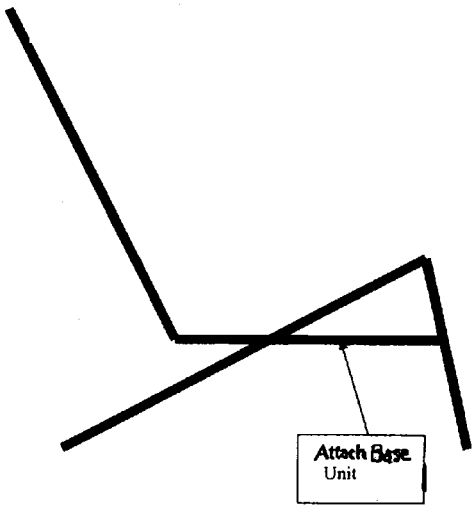
FIG. 19. is a diagrammatic illustration of a generic collapsible beach chair for use with the portable anti-theft device of the present invention.

The portable anti-theft device 1 of the present invention is suitable, and is adapted for, attachment to portable, collapsible outdoor furniture, such as to the shaft of a collapsible beach umbrella (FIG. 18) or to a leg, arm, or other suitable portion of a foldable beach chair (FIG. 19), thereby rendering such furniture no longer fully collapsible rendering the furniture cumbersome and difficult to take and also acting as a visual signal that the furniture is being taken with the anti-theft device 1 still attached. It may even be suitable for attachment to a suitable outdoor feature, such as the trunk of a shrub or small tree or the like.

The portable antitheft device of the present invention is effective in preventing the casual theft of small, valuable belongings in two ways. First, valuables are secured in an opaque, lockable container made of high-strength material. Potential thieves will not be able to discern what, if any, valuables are in the container and will be unable to open the container without drawing undue attention to themselves. Because of the unique design of the portable antitheft device of the present invention, the lockable container, or security shell, can be affixed to a beach umbrella in such a location on the umbrella, namely its shaft (FIG. 18), as to make the umbrella unable to be closed. This would require a potential thief to carry the umbrella in a fully open position (with the lockable container attached) if a theft was attempted. This visibility would make this an undesirable target for casual theft. Rather than the audible deterrence of an alarm, the open umbrella would provide a visual deterrence.

The tubular base 20 comprises a cylindrical tube 22 terminating at least at one end, and preferably at each end, with a radially-extending stop 23 that prevents the security shell 100 from being pulled axially up or down the cylindrical tube 22 and off the base 20. In an embodiment of the portable antitheft device of the present invention, the cylindrical tube 22 terminates at its top end with a top flange 24 and terminates at its bottom end with a bottom flange 26. It has these flange extensions on the top and bottom ends of the tube so as to keep the lockable security shell container 100 from moving translationally beyond the top or bottom edges of the base unit 20. The flanges 24 and 26 prevent removal of the security shell by sliding the security shell 100 off the tubular base 20. The tube 22, in top plan comprises a central interior cylindrical channel 28 and a generally cylindrical outer periphery 30. Each of the top flange 24 and the bottom flange 26 are annular in top plan with each having a central circular aperture 24*a* and 26*a*, respectively, that coincides with the central cylindrical channel 28 and has the same inner diameter as that channel 28. The outer periphery of each of the top flange and the bottom flange are circular in top plan and are greater in diameter than the outer diameter of channel 28. The flanges 24 and 26 on the top and bottom of the base unit 20 perform two functions. First, they serve to keep any sand or other debris from entering the locking security shell container 100. Secondly, they ensure that the base unit 20 and its associated security shell 100 is properly placed and kept immobile.

The tube 22 comprises a plurality of partially cylindrical tube segments, such as a pair 22*a* and 22*b* that are joined along one edge of each segment by a hinged connection 32.

Hinged connection 32 comprises a first hinge segment 34*a* formed in the distal edge of tube segment 22*a* and a second hinge segment 34*b* formed in the confronting distal edge of tube segment 22*b*. First and second hinge segments 34*a* and 34*b* are operatively joined by a headed cylindrical hinge pin 34*c* with a threaded end passing through them and held in place by a threaded nut 34*d*. The head of the hinge pin 34*c* and the nut 34*d* are accessible by an arcuate cutout 24*a*, 24*b*, 26*a*, and 26*b* in each of the top and bottom flanges of each of tube segments 22*a* and 22*b* as may be seen in FIGS. 11 and 12. Alternatively, the hinge pin 34*c* may be pushin fastener pin, thereby eliminating the need for a nut 34*b*. The axis of rotation of the hinge 32 (and hinge pin 34*c*) is parallel to the longitudinal central axis of the tube 22. By opening the hinged segments 22*a* and 22*b*, such as two halves, of the base unit 20 by means of the hinge 32, the base unit 20 can readily be placed on a portion S of a piece of foldable portable furniture (such as the shaft of a collapsible beach umbrella), encircling the portion S, and attached thereto.

As may be seen in FIGS. 7, 8, 9, and 13-18 on the front of the tubular component 22 opposite the hinge 32 is a closure mechanism that closes the base 20 on the portion S. It comprises two parts. On one tube segment 22*a* is a first tab-shaped extension 34 that projects from the left side of tube segment 22*a*. It has a threaded aperture 36 through it large enough to accommodate a threaded shaft 38. On the other side of the tube is a second tab-shaped extension 40 that projects from the right side tube segment 22*b*. It has a threaded aperture 42 through which the threaded shaft 38 is passed. When the two halves 22*a* and 22*b* of the tube 22 are closed, the second tab 40 is located behind first tab 34 and the aperture 42 in tab 40 aligns with the threaded aperture 36 in tab 34. The threaded shaft 38 may be provided with an enlarged diameter circular gripping wheel 44 to facilitate rotation of the shaft 28 to tighten or loosen it. As illustrated in FIGS. 5, 6, 11, 12, and 15, the portion S may be provided with a threaded aperture A so that, with threaded aperture 36 aligned with aperture A, threading the shaft 38 through aperture 36 and aperture 42 and continuing to rotate it will thread the shaft into and through aperture A, thereby positively affixing device 1 to the portion S and doing so in a removable manner. Alternatively, the portion S may lack an aperture and the base 20 may be secured to the portion S by tightening the shaft 28 against the surface of the shaft S so that the distal end of the shaft 28 clamps the base 20 and the portion S and frictionally prevents movement of base 20 with respect to portion S.

To install the base 20 on a beach umbrella (or any similar item) the tube 22 is opened via the hinge 32. The base 20 is placed around the portion S to which it is to be attached. The two halves 22*a* and 22*b* of the tube 22 are closed together—thereby moving the tab 40 on the right side of segment 22*b* (and its associated aperture 42) behind the threaded aperture 36 on tab 34 on segment 22*a* and into alignment with aperture 36. Shaft 38 is placed in the threaded aperture 36 and tightened until the base 20 is securely fastened to the portion. This action both locks the two halves 22*a* and 22*b* of the base unit 20 together and locks the entire base unit 20 in place on the portable furniture.

The security shell 100 comprises a pair of clamshell-shaped half shells 102 and 104 joined by a hinge 106. Each half-shell comprises an upper frustro-conical portion 102*a* and 104*a* and a lower frustro-conical portion 102*b* and 1041), the lower portion 102*b* and 104*b* being an inverted frustro-conical section. The top and bottom of each of these half shells 102 and 104 have semicircular holes which, when the security shell 100 is closed, create a circular aperture 108 identical in size to the outer diameter of the outer periphery 30 of tube 22 of the base 20. In an alternative embodiment, the aperture 108 has a greater diameter than the outside diameter of the outer periphery 30 of the tube 22 so that the shell 100 can rotate on the base 20 thereby not allowing a thief to get purchase or leverage on the shell 100 with respect to the base 20 and to torque the device 1 off its anchoring furniture. Both sides 102 and 104 of the security shell 100 have outwardly extending tabs 110 and 112 with holes 110*a* and 112*a* in them to accommodate a locking device (not shown) located on the side of the security shell opposite of the hinge 106.

Figure 20:
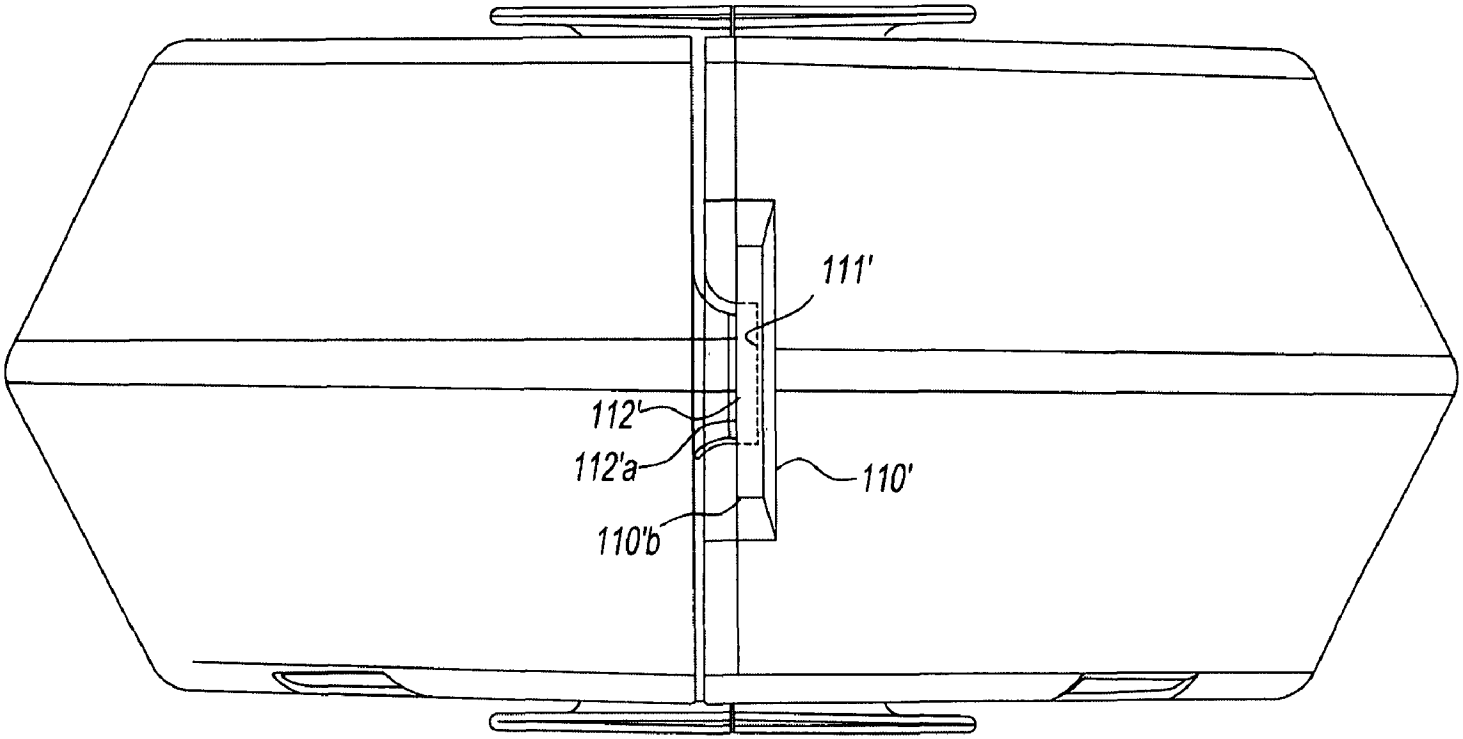
FIG. 20 is a elevation view of an alternative embodiment of the portable anti-theft device of the present invention.
Figure 21:
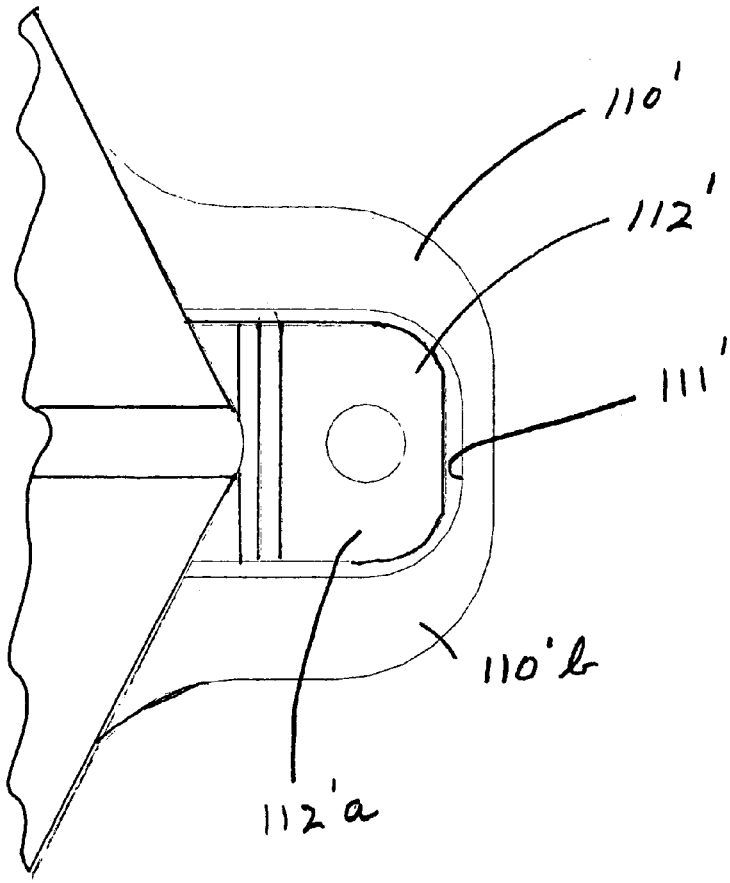
FIG. 21 is a elevation view in enlarged scale of a portion of the alternative embodiment of FIG. 20 of the portable anti-theft device of the present invention.

In the embodiment shown in FIGS. 1-17, the tabs 110 and 112 abut each other when the half shells 102 and 104 are closed. In an alternative embodiment (FIGS. 20 & 21), one tab 110' is provided with a recess 111' and the other tab 112' is reduced in dimension (length and width, for example) so that the tab 112' fits into the recess 111' of tab 110' and the outer surface 112'*a* of tab 112' lies flush with the corresponding surface 110'*b* of tab 110'. This hampers access to the space between the confronting abutting surfaces of tabs 110' and 112', such as by a tool, for prying the half shells 102 and 104 apart.

When the hinge 106 connecting the two half shell 102 and 104 is closed, these tabs 110 and 112, and their associated apertures 110*a* and 112*a*, are aligned. The axis of rotation of the hinge 106 is parallel to the longitudinal central axis of the base 20 and the longitudinal central axis of the security shell 100. The height of the security shell 100 from its bottom surface 114 to its top surface 116 is at least substantially equal to the distance from the top surface of the bottom flange 26 to the bottom surface of the top flange 24 so that, upon closing the security shell 100, the security shell 100 cannot shift axially on the portion S but may optionally rotate around the outer cylindrical surface of the tube 22 of the base 20. Optionally, the aperture 108 is dimensioned to permit rotation so that a thief would have difficulty getting sufficient grip and purchase on the outer surface of the shell to twist it off the base 20 or the portion S, or both. As may be seen in FIGS. 14 and 15, each half shell 102 and 104 is provided with an upstanding bottom lip 118*a* and 118*b* that extends across the diameter of the half shell 102 and 104. The lip 118*a* and 118*b*, along with the lower portion of each half shell, provides a recess or walled tray to retain small items in the half shell 102 and 104. The confronting edges of half shell 102 and half shell 104 may be provided with overlapping peripheral lips around their confronting periphery so as to close the space between the confronting edges of half shell 102 and half shell 104. The bottom surface of each lower portion of each half shell 102 and 104 may be provided with reinforcing ribs to strengthen the shell 100.

When placed between the flanges of the base unit 24 and 26 and closed (as described above), the security shell 100 is prevented from being readily removed from the portable furniture. In addition, by this design, access to the threaded shaft 38 securing the base unit 20 to the portable furniture is prevented by the security shell 100 that covers the closure mechanism.

The shape of the security shell 100 may vary based on the type of anchoring device that is used. The security shell 100 is hollow, which provides significant storage space for belongings to be stored.

To secure valuables, the user places them in the storage spaces of either one or both halves 102 and 104 of the security shell 100. The security shell 100 is then placed between the two flanges 24 and 26 on the base unit 20 with the tube 22 of the base unit 20 in the circular cutouts forming the circular aperture 108 of the security shell 100. The two halves 102 and 104

In use, the portable anti-theft device 1 of the present invention is placed on, and fixedly secured with respect to, a piece of collapsible or foldable outdoor furniture in such a way as to prevent the collapse or folding of that piece of furniture into a transportable or storable condition. As installed, it prevents anyone from moving the piece of furniture easily and without drawing attention. In the case of a collapsible beach umbrella (see FIG. 18), the device 1 is attached to the shaft of the umbrella in sufficient proximity to the runner of the umbrella (in the runner's position when the umbrella is open) that the runner cannot fully move down the shaft. That is, the attachment of the device 1 to the umbrella shaft stops axial translation of the runner on the shaft of the umbrella. In the case of a collapsible or folding outdoor chair (FIG. 19), the device 1 is attached to the leg, arm, back, or other relevant part in sufficient proximity to a pivot that, upon folding or collapse, prevents the chair from being collapsed or folded to a storage or transport configuration. That is, the attachment of the device 1 to the chair stops rotational pivoting of one or more structural elements of the chair. Hence, the purpose of the device 1 is to stop axial translation or pivotal rotation of one structural element of a piece of collapsible or foldable outdoor furniture with respect to another structural element of that piece of furniture, thereby impairing transportation or storage of that piece of furniture.

I claim:

1. A portable anti-theft device for attachment to a piece of portable outdoor furniture comprising a. a base attachable to said outdoor furniture comprising
   i. a segmented tubular body comprising at least two semitubular segments and having an inner peripheral surface;
   ii. longitudinally opposed stops extending outwardly from said base; and
   iii. a closure for attaching said base to said outdoor furniture;

b. a hollow security shell attachable to the base comprising
   i. a first shell segment,
   ii. a second shell segment,
   iii. said first and second shell segments defining an enclosed internal space with a pair of vertically-opposed apertures,
   iv. a hinge joining said first and second shell segments,
   v. said security shell being configured to enclose said closure.

2. A portable anti-theft device as recited in claim 1, wherein said closure comprises a. a first extension of a first of said segments;
b. a second extension of a second of said segments;
c. a member secured to at least one of said extensions and extending radially inwardly of said base a distance greater than said inner peripheral surface and at least into contact with the piece of outdoor furniture, said member locking said extensions in fixed, closed position with respect to each other.

3. A portable anti-theft device as recited in claim 1, wherein a. said first shell segment comprises a first half shell of a pair of clamshell-shaped, vertically opposed half shells and
b. said second shell segment comprises a second half shell of a pair of clamshell-shaped, vertically opposed half shells.

4. A portable anti-theft device as recited in claim 3, wherein said security shell, when said half shells are closed, comprises a. an upper frustro-conical portion and
b. a lower frustro-conical portion, said lower portion being an inverted frustro-conical configuration.

5. A portable anti-theft device as recited in claim 3, wherein each of said half shells a. has a lower edge, said edges confronting each other when said shell is closed and
b. is provided with transverse upstanding rib on the lower edge of said half shell.

6. A portable anti-theft device as recited in claim 1, wherein said stops comprise a. an upper annular flange, and
b. a lower annular flange.

7. A portable anti-theft device as recited in claim 1, wherein said at least two semitubular segments comprise a pair of semi-cylindrical tube segments.

8. A portable anti-theft device as recited in claim 7, wherein said semi-cylindrical tube segments are joined together by a hinge.

9. A portable anti-theft device as recited in claim 1, wherein said device is removably affixed to a collapsible umbrella, said umbrella having a shaft and a rider axially translatable on said shaft.

10. A portable anti-theft device as recited in claim 9, wherein said device is so affixed in adjacent proximity to said rider when said umbrella is open.

11. A portable anti-theft device as recited in claim 1, wherein said device is removably affixed to a folding piece of outdoor furniture, said piece of furniture having at least one structural element in rotational pivoting relationship to another structural element of said piece of furniture for folding said piece of furniture by pivotally rotating said one structural element with respect to said other structural element.

12. A portable anti-theft device as recited in claim 11, wherein said device is so affixed to said first structural element to stop said pivotal rotational movement.

* * * * *